US006786999B2

(12) United States Patent
Goodnow et al.

(10) Patent No.: US 6,786,999 B2
(45) Date of Patent: Sep. 7, 2004

(54) DOCTOR BLADE HOLDER

(75) Inventors: Ronald F. Goodnow, Leicester, MA (US); Robert A. Reid, Charlton City, MA (US); Allen J. Brauns, Sturbridge, MA (US)

(73) Assignee: Kadant Web Systems, Inc., Auburn, MA (US)

( * ) Notice: Subject to any disclaimer, the term of this patent is extended or adjusted under 35 U.S.C. 154(b) by 25 days.

(21) Appl. No.: 10/109,449

(22) Filed: Mar. 28, 2002

(65) Prior Publication Data

US 2002/0153115 A1 Oct. 24, 2002

Related U.S. Application Data

(60) Provisional application No. 60/284,453, filed on Apr. 18, 2001.

(51) Int. Cl.[7] ..... D21G 3/00

(52) U.S. Cl. ..... 162/281; 162/272; 15/256.51

(58) Field of Search ..... 162/280–282, 162/272, 199; 15/256.5, 256.51, 256.53; 101/157, 164, 350.6; 118/261, 413, 120–126; 210/396; 399/284; 427/356; 198/499

(56) References Cited

U.S. PATENT DOCUMENTS

| | | | | | |
|---|---|---|---|---|---|
| 3,040,442 | A | * | 6/1962 | Overton | 34/110 |
| 3,748,686 | A | * | 7/1973 | Winterburn et al. | 15/256.51 |
| 3,778,861 | A | | 12/1973 | Goodnow et al. | 15/256.51 |
| 3,803,665 | A | | 4/1974 | Winterburn et al. | 15/256.51 |
| 3,866,266 | A | | 2/1975 | Dunlap | 15/256.51 |
| 4,367,120 | A | * | 1/1983 | Hendrikz | 162/281 |
| 4,665,859 | A | | 5/1987 | Dunlap et al. | 118/126 |
| 5,279,710 | A | | 1/1994 | Aikawa | 162/281 |
| 5,284,516 | A | | 2/1994 | Sieberth | 118/123 |
| 5,408,720 | A | | 4/1995 | Miles | 15/256.51 |
| 6,328,853 | B1 | | 12/2001 | Goodnow et al. | 162/281 |
| 6,491,754 | B1 | * | 12/2002 | Graf et al. | 118/123 |

FOREIGN PATENT DOCUMENTS

| | | |
|---|---|---|
| WO | WO 00 44981 | 8/2000 |

* cited by examiner

*Primary Examiner*—Steven P. Griffin
*Assistant Examiner*—Eric Hug
(74) *Attorney, Agent, or Firm*—Samuels, Gauthier & Stevens

(57) ABSTRACT

An apparatus for doctoring a roll surface including a pivot bar adapted to be mounted on a doctor back and which the pivot bar defines an upwardly projecting fulcrum. A first shelf projects forwardly beyond the fulcrum and a top plate pivotally supported on and projecting forwardly beyond the fulcrum overlies the first shelf. The top platen is held downwardly against the fulcrum. Blade support members are carried by and cooperate with the top plate to define forwardly open slots, which slots are configured and dimensioned to receive a rear edge of a forwardly projecting doctor blade. The blade support members have rearwardly projecting second shelves underlying the first shelf and a loading mechanism is interposed between the first and second shelves for pivoting the top plate on the fulcrum in a direction urging the doctor blade against the roll surface.

10 Claims, 2 Drawing Sheets

DOCTOR BLADE HOLDER

CROSS REFERENCE TO RELATED APPLICATION

This application claims priority from provisional patent application Serial No. 60/284,453 filed Apr. 18, 2001.

BACKGROUND DISCUSSION

1. Field of the Invention

This invention relates generally to web processing machines, e.g., paper machines and the like, and is concerned in particular with an improved apparatus for doctoring the rolls of such machines.

2. Description of the Prior Art

In known doctoring arrangements of the type disclosed for example in U.S. Pat. No. 5,279,710 (Aikawa); U.S. Pat. No. 4,906,335 (Goodnow et al.) and U.S. Pat. No. 4,665,859 (Dunlap et al.), the doctor blades are carried by holders that are rotatable about pivot rods and the like. Under certain operating conditions, these holders have a tendency to vibrate or chatter due to the clearances that must necessarily be introduced between the relatively rotatable components.

In other known doctoring arrangements of the type disclosed for example in U.S. Pat. No. 6,328,853 (Goodnow et al.), the doctor blades are carried on flexible top plates that are fixed to and extend in cantilever fashion from base components of the holders. Such arrangements beneficially minimize the clearances that are the source of vibration and chattering problems. However, this advantage is partially offset by attendant compromises in blade conformability and uniformity of blade loading across the width of the surface being doctored, and a diminished ability to accommodate cross machine thermal expansion and contraction of the top plate.

SUMMARY OF THE INVENTION

An objective of the present invention is to provide an improved doctoring apparatus that eliminates the clearances that are the source of vibration and chattering problems, and that does so in a manner that does enhances blade conformability and uniformity of blade loading, while also accommodating relatively free cross machine thermal expansion and contraction of the blade carrying top plate.

These and other features and objectives of the present invention will now be described in greater detail with reference to the accompanying drawings, wherein:

DESCRIPTION OF PREFERRED EMBODIMENT

Figure 1:
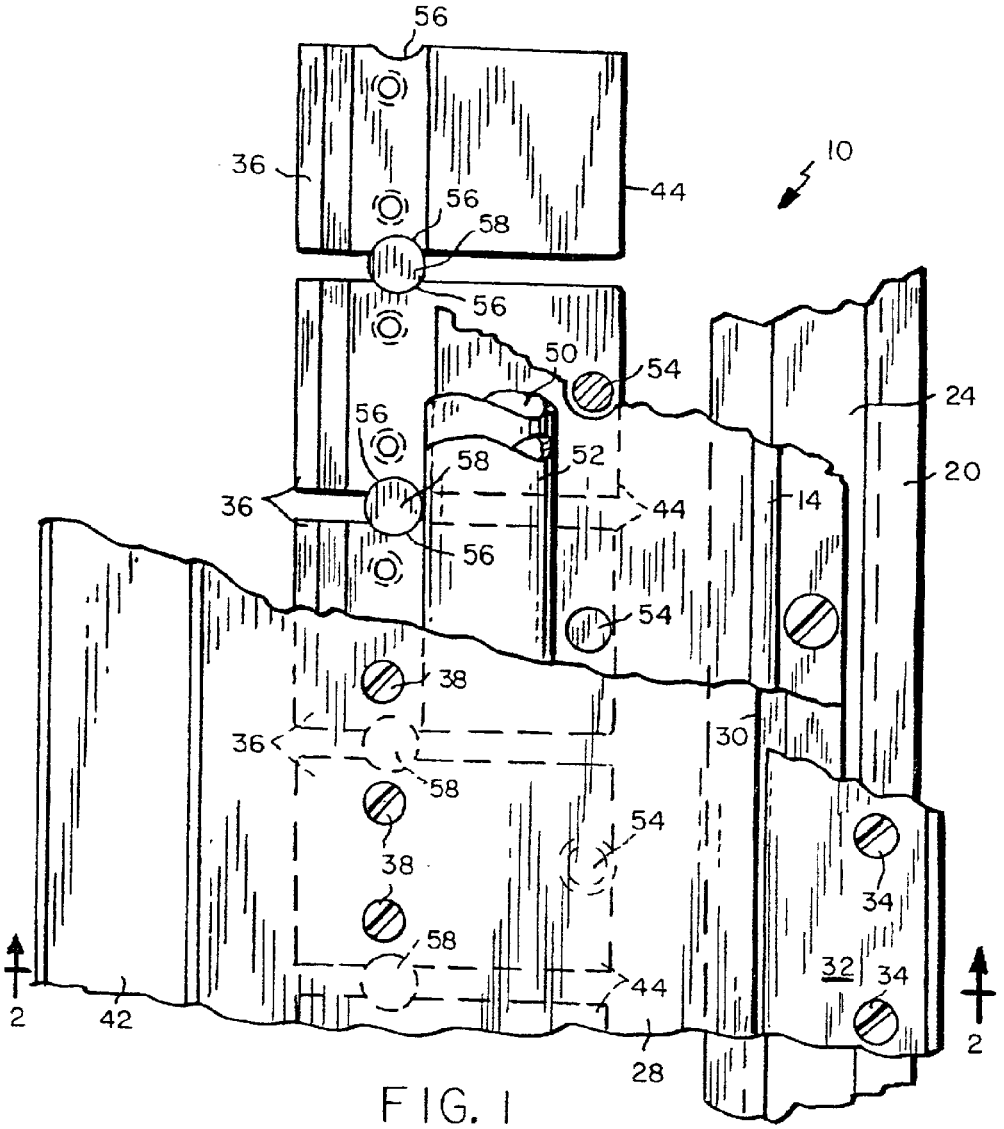
FIG. 1 is a partial top plan view, with portions broken away, of a doctoring apparatus in accordance with the present invention.
Figure 2:
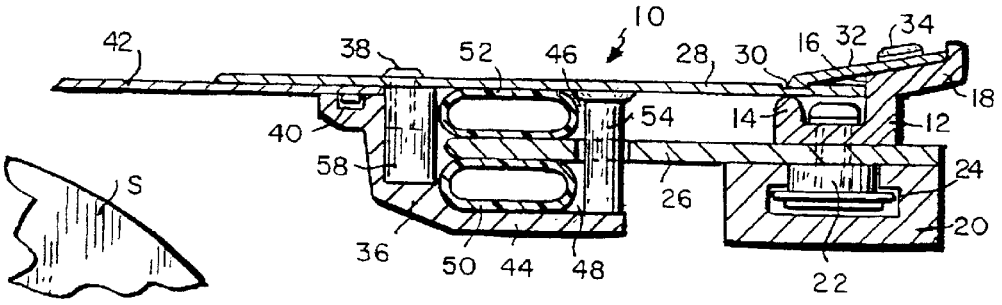
FIG. 2 is a sectional view taken along line 2—2 of FIG. 1, with components of the apparatus shown in a neutral position.

With reference initially to FIGS. 1 and 2, an apparatus for doctoring a moving surface "S" is generally depicted at 10. The apparatus includes a pivot bar 12 configured to define a forwardly disposed upwardly projecting fulcrum 14 spaced from an abutment wall 16 by an intermediate groove, with a rearwardly projecting inclined ledge 18. The pivot bar is adapted to be mounted on a doctor back 20 or like support by any convenient means, such as for example either spaced or continuous guide components 22 captured in an undercut groove 24.

A first shelf 26 underlies and projects forwardly from the pivot bar 12 and its fulcrum 14. A flexible top plate 28 rests on the fulcrum 14. A rear edge of the top plate abuts wall 16, and a forward portion of the top plate overlies the forwardly projecting portion of the first shelf 26. A shallow channel-shaped groove 30 extends in the cross machine direction across the upper surface of top plate 28.

A retainer strip 32 is secured to the ledge 18 by screws 34. The forward edge of strip 32 extends in cantilever fashion from the ledge 18 into the surface groove 30 and serves to resiliently urge and lightly clamp the top plate downwardly onto the fulcrum 14.

Blade support members 36 are attached by screws 38 to the underside of the forwardly projecting portion of the top plate 28. The forward portions of the blade support members cooperate with the underside of the top plate to define forwardly open slots 40 configured and dimensioned to receive and retain the rear edge of a doctor blade 42. Rearwardly projecting portions of the blade support members define second shelves 44 underlying the top plate 28. The first shelf 26 subdivides the space between the second shelves 44 and the top plate 28 into upper and lower compartments 46, 48.

An inflatable loading tube 50 occupies the lower compartment 48, and an inflatable unloading tube 52 occupies the upper compartment 46. The tubes 50, 52 are retained in their respective compartments by pins 54 loosely received in holes in the first shelf 26, and captured between the underside of the top plate 28 and the second shelves 44.

As can best be seen in FIG. 1, the blade support members 36 are spaced one from the other in the cross machine direction, and are provided with confronting partially circular grooves 56. Cylindrical elastomer plugs 58 extend into and are captured between the grooves 56 to serve as seals for excluding contaminants from penetrating into the compartments 46, 48.

The top plate 28 can be made from a composite material or a metal such as stainless steel. Top plate thickness will typically range from 1.27 to 3.175 mm.

Figure 3:
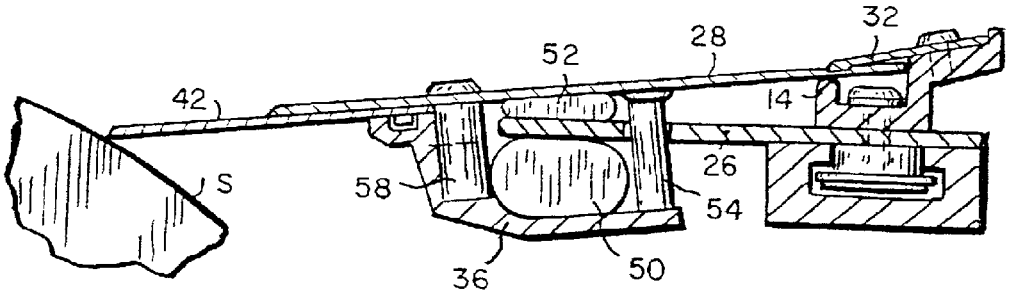
FIGS. 3 and 4 are views similar to FIG. 2 respectively showing the apparatus in loaded and unloaded conditions relative to the roll surface being doctored.

In operation, as shown in FIG. 3, the loading tube 50 is inflated and expanded with a corresponding deflation and collapse of unloading tube 52. This causes the top plate 28 to pivot counterclockwise on fulcrum 14, urging the working edge of doctor blade 42 downwardly against the roll surface S. The preloading force exerted by the retainer strip 32 is sufficient to eliminate any clearances or play at the pivot axis defined at the line contact between the underside of the top plate and the fulcrum 14. However, frictional contact between the top plate and both the retainer strip 32 and the fulcrum 14 is sufficiently light to as not to impede both thermal expansion and contraction, and the slight shifting of the top plate in the machine direction as it pivots and its rear edge moves up the abutment wall of the pivot bar. The flexural properties of the top plate function in concert with its unique pivotal support and the loading force exerted by the expanded tube 50 to provide a uniform and constant loading between the doctor blade and the roll surface, irrespective of irregularities in the roll surface and gradual wear of the blade.

The elastomer plugs 58 coact with adjacent surfaces of the blade support members 36 to exclude contaminants from fowling the compartments 46, 48.

Figure 4:
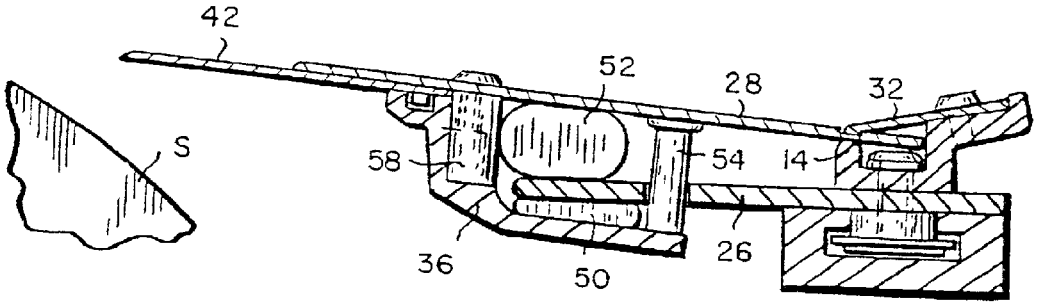

As shown in FIG. 4, the doctor blade 42 may be removed from the roll surface by simply deflating and collapsing the loading tube 50 with a corresponding inflation and expansion of the unloading tube 52. At all times, the loading and unloading tubes 50, 52 are securely retained in their respective compartment by the pins 54.

In light of the foregoing, it will now be appreciated by those skilled in the art that various changes may be made to the embodiment herein chosen for purposes of disclosure without departing from the inventive concept defined by the appended claims. Non limiting examples of such changes include relocating the surface groove 30 to the underside of the top plate, and elimination of the rearwardly projecting ledge 18 in favor of a more robustly configured pivot bar with a thicker base.

We claim:

1. Apparatus for doctoring a roll surface, comprising:

a pivot bar adapted to be mounted on a doctor back, said pivot bar defining an upwardly projecting fulcrum;

a first shelf projecting forwardly beyond said fulcrum;

a top plate pivotally supported on and projecting forwardly beyond said fulcrum to overlie said first shelf;

retainer means for holding said top plate downwardly against said fulcrum;

blade support members carried by and cooperating with said top plate to define forwardly open slots, said slots being configured and dimensioned to receive a rear edge of a forwardly projecting doctor blade, said blade support members having rearwardly projecting second shelves underlying said first shelf; and loading means interposed between said first and second shelves for pivoting said top plate on said fulcrum in a direction urging said doctor blade against said roll surface.

2. The apparatus of claim 1 further comprising unloading means interposed between said top plate and said first shelf for pivoting said top plate in a direction urging said doctor blade away from said moving surface.

3. The apparatus of claim 1 wherein said retainer means resiliently urges said top plate downwardly again said fulcrum.

4. The apparatus of claim 3 wherein said retainer means comprises a resilient plate projecting in cantilever fashion from said pivot bar into frictional contact with an upper surface of said top plate.

5. The apparatus of claim 4 wherein a forward edge of said resilient plate is received in a channel-shaped groove in said upper surface.

6. The apparatus of claim 2 wherein said first shelf subdivides a space between said top plate and said second shelf into vertically aligned upper and lower compartments, and wherein said unloading and loading means are located respectively in said upper and lower compartments.

7. The apparatus of claim 6 wherein said loading and unloading means comprise inflatable tubes.

8. The apparatus of claim 7 wherein said tubes are retained in said compartments by pin members that extend through said first shelf and that are captured between said top plate and said bottom shelves.

9. The apparatus as claimed in claim 1 wherein said blade support members are spaced one from the other in the cross machine direction, and wherein the spaces between said blade support members are sealed by elastomer plugs.

10. The apparatus as claimed in claim 9 wherein said plugs are cylindrical and captured between partially circular confronting grooves in said blade support members.

* * * * *